US008212165B2

(12) United States Patent
Fujita et al.

(10) Patent No.: US 8,212,165 B2
(45) Date of Patent: Jul. 3, 2012

(54) SWITCH

(75) Inventors: Daisuke Fujita, Tokyo (JP); Hitoshi Sadakuni, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 259 days.

(21) Appl. No.: 12/741,512

(22) PCT Filed: Nov. 6, 2007

(86) PCT No.: PCT/JP2007/071560

§ 371 (c)(1),
(2), (4) Date: May 5, 2010

(87) PCT Pub. No.: WO2009/060512

PCT Pub. Date: May 14, 2009

(65) Prior Publication Data

US 2010/0219053 A1 Sep. 2, 2010

(51) Int. Cl.
*H01H 1/00* (2006.01)

(52) U.S. Cl. ..... 200/274

(58) Field of Classification Search ..... 200/254, 200/273–274, 554, 400, 401; 218/1, 7, 14, 218/44, 6, 43, 45, 67, 80, 86, 152–154
See application file for complete search history.

(56) References Cited

U.S. PATENT DOCUMENTS

| | | | | |
|---|---|---|---|---|
| 4,414,451 | A * | 11/1983 | Bleidt et al. | 218/86 |
| 4,467,161 | A * | 8/1984 | Fox et al. | 200/281 |
| 4,678,876 | A | 7/1987 | Westbrock et al. | |
| 5,566,818 | A * | 10/1996 | Kuboyama et al. | 200/271 |

FOREIGN PATENT DOCUMENTS

| | | | |
|---|---|---|---|
| GB | 1 331 825 | | 9/1973 |
| JP | 48-022974 | A | 3/1973 |
| JP | 51-3868 | U | 1/1976 |
| JP | 51-128254 | U | 10/1976 |
| JP | 53-159563 | U | 12/1978 |
| JP | 57-009124 | U | 1/1982 |
| JP | 58-157073 | A | 9/1983 |

(Continued)

OTHER PUBLICATIONS

English-language translation of Japanese Decision of Patent Grant dated Jul. 13, 2010 issued in corresponding Japanese Patent Application No. 2010-133274.

(Continued)

*Primary Examiner* — Edwin A. Leon
(74) *Attorney, Agent, or Firm* — Buchanan Ingersoll & Rooney PC

(57) ABSTRACT

A fixed contact includes a pair of conduction members that are arranged opposedly and in parallel to each other such that tip ends of the conduction members are oriented toward an opening, a support frame (pedestal member) that tiltably supports bases of the conduction members, a leaf spring (pressurizing member) that biases the conduction members in a direction in which the tip ends of the conduction members approach each other, and an outer frame (shielding member) that covers peripheries of the conduction members and the leaf spring and shields them from an outside electric field, the leaf spring is arranged on an outer side of the opposed conduction members, and the outer frame is engaged with the tip end of the conduction member, thereby maintaining an opening width between the tip ends of the conduction members at a predetermined width.

17 Claims, 9 Drawing Sheets

FOREIGN PATENT DOCUMENTS

| | | | |
|---|---|---|---|
| JP | 59-165613 | U | 11/1984 |
| JP | 60-68518 | A | 4/1985 |
| JP | 05-094981 | U | 12/1993 |
| JP | 9-320402 | A | 12/1997 |
| JP | 10-228940 | A | 8/1998 |
| JP | 10-321084 | A | 12/1998 |
| JP | 2002-42614 | A | 2/2002 |
| JP | 2002-110007 | A | 4/2002 |

OTHER PUBLICATIONS

International Search Report for PCT/JP2007/071560 completed Jan. 30, 2008.

Written Opinion for PCT/JP2007/071560 completed Jan. 30, 2008.

European Search Report dated May 13, 2011 issued in the corresponding European Patent Application No. 11159973.4-2214.

* cited by examiner

SWITCH

TECHNICAL FIELD

The present invention relates to a switch, such as a gas-insulated switchgear, and particularly relates to a switch having a blade-type moving contact, which is rotatably and pivotally supported and reciprocates such that a free end of the blade-type moving contact draws a rotation locus, and a fixed contact that has conduction members with which the moving contact comes into contact.

BACKGROUND ART

In a switch having a blade-type moving contact, which is rotatably and pivotally supported and reciprocates such that its free end draws a rotation locus, and a fixed contact that has conduction members with which the moving contact comes into contact, a pressurizing member that biases the conduction members in a direction in which tip ends of the conduction members approach each other is provided. Thus, the conduction members sandwich the moving contact with an appropriate pressure. The fixed contact is supported such that the fixed contact is movable with respect to the moving contact.

The pressurizing member applies a force in a direction in which the tip ends of a pair of the conduction members, which are arranged opposedly and substantially in parallel, approach each other. For example, a method of arranging a coil spring between a pair of conduction members and a method of arranging laminated leaf-springs on outer sides of conduction members have been proposed (see, for example, Patent Documents 1 and 2). As for a supporting method of the fixed contact, there has been proposed a method of supporting connecting conductors using bolts at both ends in a direction along which the moving contact is brought into contact (see, for example, Patent Document 2).

Patent Document 1: Japanese Utility Model Laid-open No. S53-159563

Patent Document 2: Japanese Patent Application Laid-open No. H10-321084

DISCLOSURE OF INVENTION

Problem to be Solved by the Invention

The space between the pair of conduction members is the space into which the blade-type moving contact enters. Therefore, when a coil spring is arranged in the space, the fixed contact becomes large in a length direction of the conduction members. Furthermore, because every pair of conduction members requires a coil spring and a pin that engages with the coil spring, the number of parts is increased. Thus, an improvement has been desired.

Generally, a predetermined opening width is maintained between the pair of conduction members, which are separate, so that the blade-type moving contact can enter normally. A regulating member that regulates the conduction members to predetermined positions is located substantially at a central portion between the pair of conduction members. The opening width between the tip ends of the conduction members tend to vary due to dimensional tolerances of the conduction members and the regulating members. Thus, an improvement has been desired.

The laminated leaf-springs can be arranged on outer sides of the conduction members while relaxing an excessive stress applied to substantially central portions of the leaf springs; however, the number of parts of the leaf springs is increased. Furthermore, it is necessary to integrally fasten leaf springs, which are laminated, to an outer frame (cover) using a bolt in order to fix the laminated leaf-spring. Accordingly, an electric field tends to be concentrated on the bolt, which is not preferable in view of shielding the electric field. Thus, an improvement has been desired.

When the fixed contact is supported at both ends in a direction, along which the moving contact is brought into contact, and when a contact conductor is arranged to cover peripheries thereof for the purpose such as downsizing the entire switch and optimizing the internal structure, there is no assembling space for mounting the fixed contact and the assembling work is hindered. Thus, an improvement has been desired.

The present invention has been made in view of the above, and an object of the present invention is to provide a switch capable of downsizing an apparatus and keeping a predetermined opening width between tip ends of conduction members with a simple method. Another object of the present invention is to provide a switch capable of movably supporting a fixed contact with a simple structure and with a simple assembling method while preventing an increase of the apparatus size.

Means for Solving Problem

To solve the problem described above and achieve the object, a switch according to a first invention has a blade-type moving contact, which is rotatably and pivotally supported and reciprocates such that a free end of the blade-type moving contact draws a rotation locus, and a fixed contact that has conduction members with which the moving contact comes into contact, wherein the fixed contact has a pair of the conduction members that are arranged opposedly and substantially in parallel to each other such that tip ends of the conduction members are oriented toward the opening, a pedestal member that tiltably supports bases of the conduction members, a pressurizing member that biases the conduction members in a direction in which the tip ends of the conduction members approach each other, and a shielding member that covers peripheries of at least the conduction members and the pressurizing member and shields them from an outside electric field, the pressurizing member is arranged on an outer side of the opposed conduction members, and the shielding member engages with the tip ends of the conduction members, overcomes a biasing force of the pressurizing member, and maintains an opening width between the tip ends of the conduction members at a predetermined width.

A switch according to a second invention has a blade-type moving contact, which is rotatably and pivotally supported and reciprocates such that a free end of the blade-type moving contact draws a rotation locus, and a fixed contact that has conduction members with which the moving contact comes into contact, wherein the fixed contact has a pair of the conduction members that are arranged opposedly and substantially in parallel to each other such that tip ends of the conduction members are oriented toward the opening, a pedestal member that tiltably supports bases of the conduction members, a pressurizing member that biases the conduction members in a direction in which the tip ends of the conduction members approach each other, and a shielding member that covers a periphery of at least the conduction members and shields them from an outside electric field, and the pedestal member is supported by a support conductor with a predetermined play so that the pedestal member is movable with respect to the moving contact.

Effect of the Invention

According to the switch of the first invention, the pressurizing member is arranged on an outer side of the opposed conduction members. The shielding member engages with the tip end of the conduction member. This engagement overcomes a biasing force of the pressurizing member and thus the opening width between the tip ends of the conduction members is maintained at a predetermined width. Therefore, the apparatus can be downsized with a simple structure, and the opening width between the tip ends of the conduction members can be accurately maintained at a predetermined width.

According to the switch of the second invention, the pedestal member is supported by the support conductor with a predetermined play such that the pedestal member is movable with respect to the moving contact. Thus, it is possible to prevent an increase of the apparatus size, and the fixed contact can be movably supported with a simple structure and a simple assembling method.

EXPLANATIONS OF LETTERS OR NUMERALS

Figure 1:
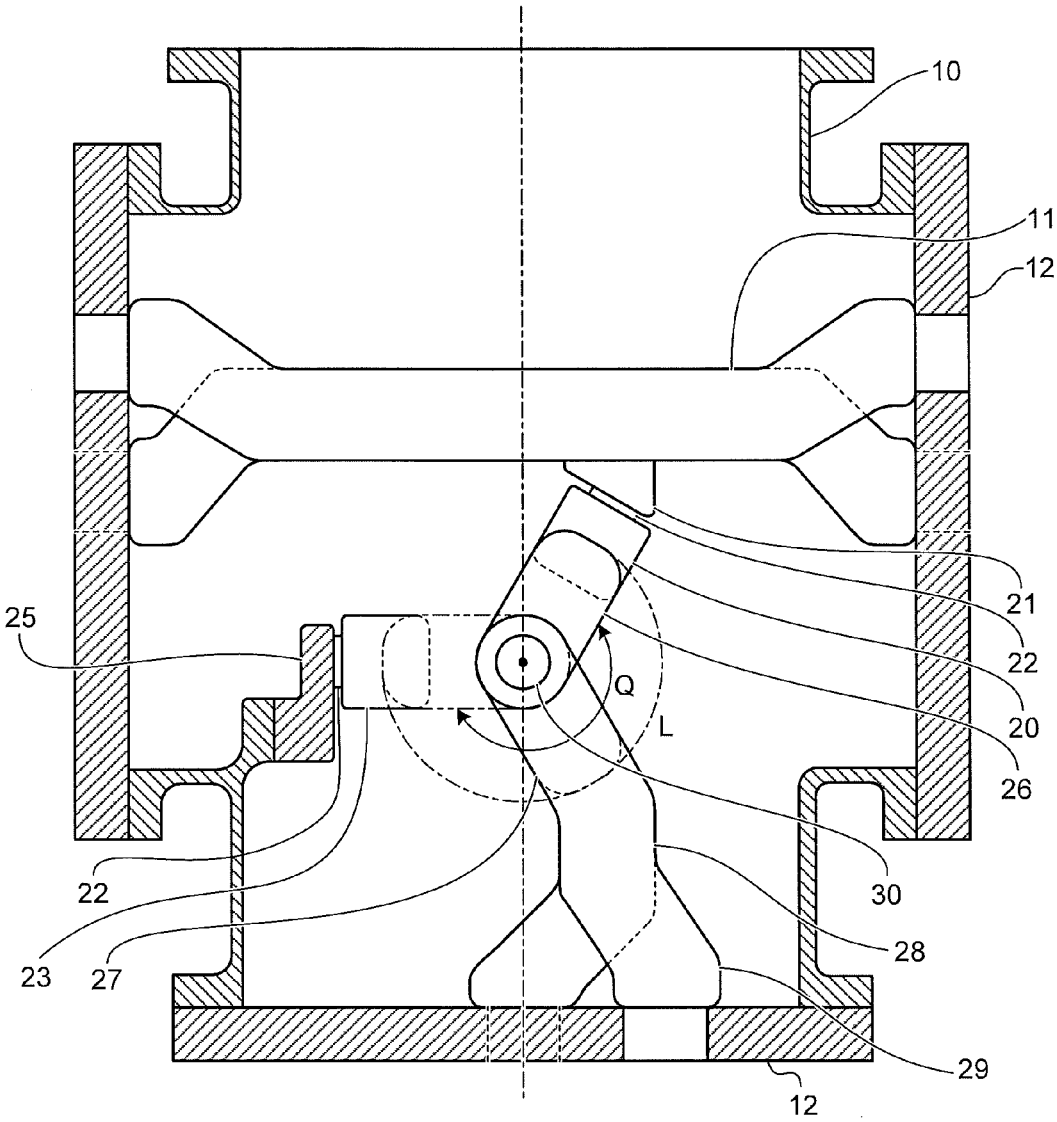
FIG. 1 is a sectional view taken along a plane extending along a main bus of a switch according to the present invention.

10 Tank
11 Main bus
12 Insulation spacer
20 Fixed contact
20*a* Opening
21 Fixed-side support conductor (support conductor)
22 Connecting conductor (support conductor)
22*a* Protrusion
23 Grounding fixed contact
25 Grounding fixed-side support conductor (support conductor)
26 Moving contact
26*a* Free end
27 Slit conductor
28 Movable-side support conductor
29 Spacer supporting conductor
30 Insulation operating shaft (rotation shaft)
31 Conduction member
31*a* Base
31*b* Notch (to-be-engaged portion)
33 Support frame (pedestal member)
33*a* Frame portion
33*b* Plate portion
33*c* Through hole
33*d* Central rectangular hole
35 Support rod
37 Fastening member
41 Retaining member
43 Leaf spring (pressurizing member)
43*a* Slit
43*b* Embossed pattern
43*c* Tooth portion
45 Outer frame (shielding member)
45*a* Bending portion (engaging portion)
45*b* Projection

BEST MODE(S) FOR CARRYING OUT THE INVENTION

Exemplary embodiments of a switch according to the present invention will be explained below in detail with reference to the accompanying drawings. The present invention is not limited to the embodiments.

Embodiment

Figure 2:
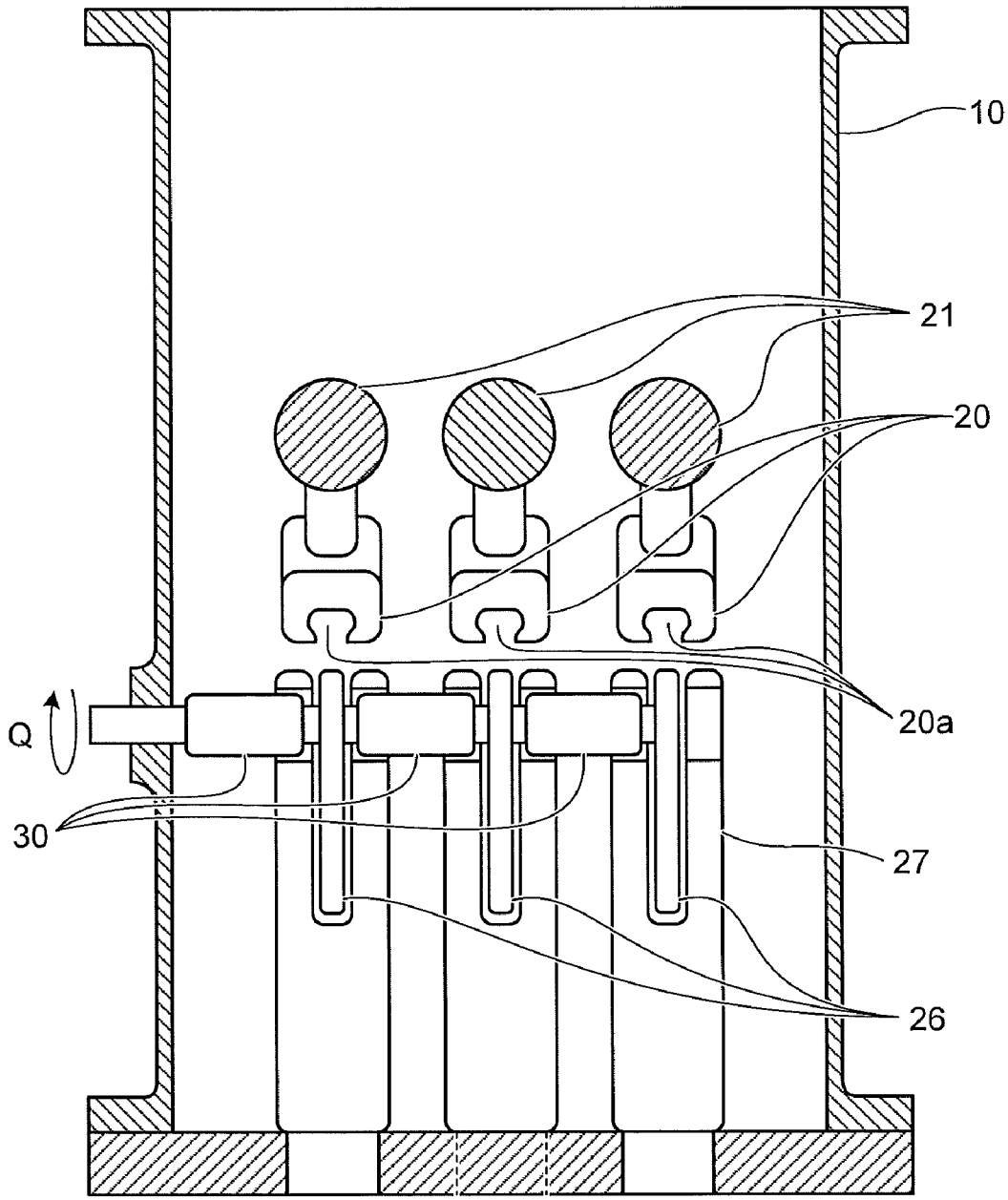
FIG. 2 is a sectional view taken along a plane extending along an insulation operating shaft of the switch.

FIG. 1 is a sectional view taken along a plane extending along a main bus of a switch according to an embodiment of the present invention. FIG. 2 is a sectional view taken along a plane extending along an insulation operating shaft of the switch. A tank 10 has an opening that is in communication with another tank. The opening is partitioned by an insulation spacer 12 and a hermetical space is formed in the tank 10. The hermetical space is filled with insulation gas, such as sulfur hexafluoride gas. A three-phase main bus 11 extending in a horizontal direction is accommodated in the tank 10. A fixed contact 20 is arranged in each phase of the main bus 11 through a fixed-side support conductor 21 and a connecting conductor 22. Three grounding fixed contacts 23 are arranged at different positions in the tank 10 through a grounding fixed-side support conductor 25 and the connecting conductor 22.

Three movable-side support conductors 28 supported by the insulation spacer 12 via a spacer connecting conductor 29 extend toward a center of the tank 10 at further different positions in the tank 10. As shown in FIG. 2, a tip end of each of the movable-side support conductors 28 is formed with a slit and is formed into a bifurcated slit conductor 27. Insulation operating shafts 30 are arranged in the slit conductors 27 to collectively penetrate three slit conductors 27. Each of the insulation operating shafts 30 is rotatably supported in a state that the insulation operating shaft 30 is insulated from the slit conductor 27 by an insulator that surrounds the insulation operating shaft 30 itself.

Blade-type (plate-like) moving contacts 26 are pivotally supported by the insulation operating shafts 30 and provided on the slit conductors 27. Each of the moving contact 26 is formed into a substantially thin long plate shape extending in the radial direction from the rotation center, and the moving contact 26 rotates around the rotation center of the insulation operating shaft 30 such that a free end of the moving contact 26 draws a rotation locus L. A tip free end 26*a* comes into contact with the fixed contact 20 or the grounding fixed contact 23. As shown in FIG. 1 with arrow Q, each moving contact 26 rotates and reciprocates between a fully closed position where the moving contact 26 comes into contact with the fixed contact 20 and a grounding position where the moving contact 26 comes into contact with the grounding fixed contact 23. The center of the reciprocation is a fully opened position where the moving contact 26 is accommodated in the slit. The fixed contact 20 is arranged on one end side of the rotation range of the moving contact 26, and the grounding fixed contact 23 is arranged on the other end side of the rotation range. A rotation angle between the slit conductor 27 and the fixed contact 20 and a rotation angle between the slit conductor 27 and the grounding fixed contact 23 are the same.

Each of the fixed contact 20 and the grounding fixed contact 23 has a substantially U-shaped cross section formed with an opening 20*a* through which the moving contact 26 enters. The opening 20*a* opens toward the insulation operating shaft 30. The fixed contact 20 and the grounding fixed contact 23 have substantially the same structures, and the structure of the fixed contact 20 is mainly described below.

Figure 3:
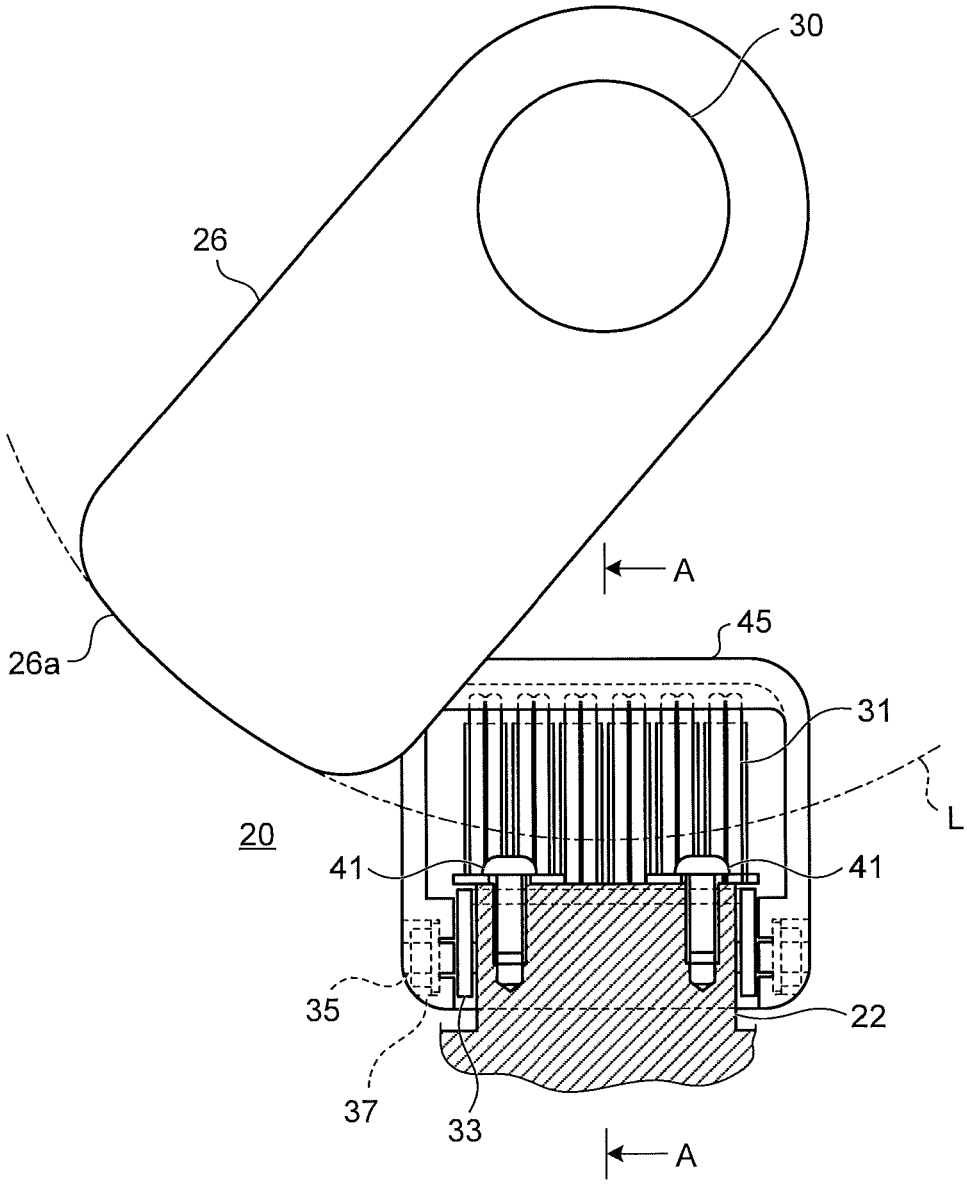
FIG. 3 is a sectional view of a fixed contact on a plane including a rotation locus of a free end of a moving contact.
Figure 4:
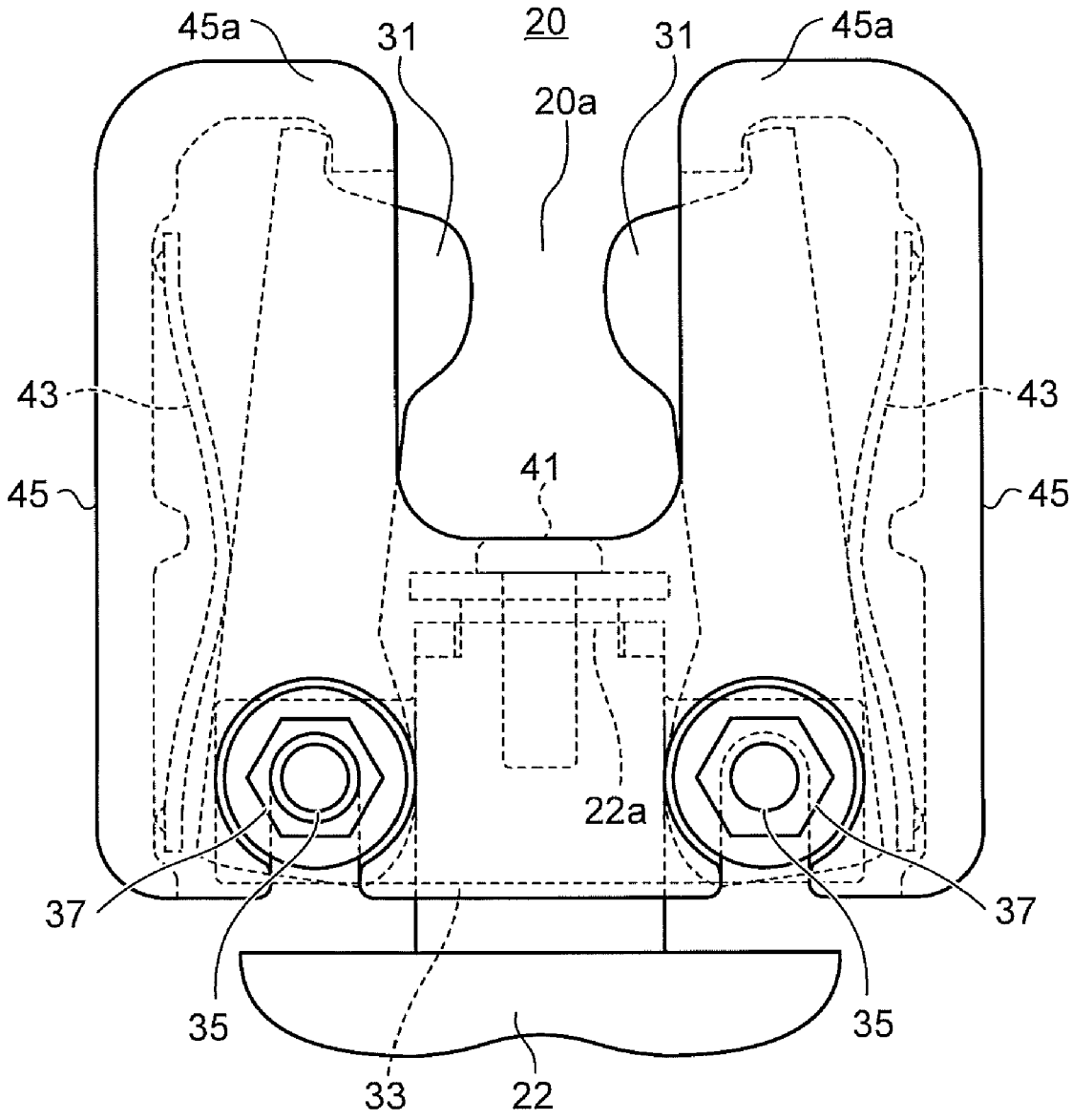
FIG. 4 is a side view of the fixed contact shown in FIG. 3.
Figure 5:
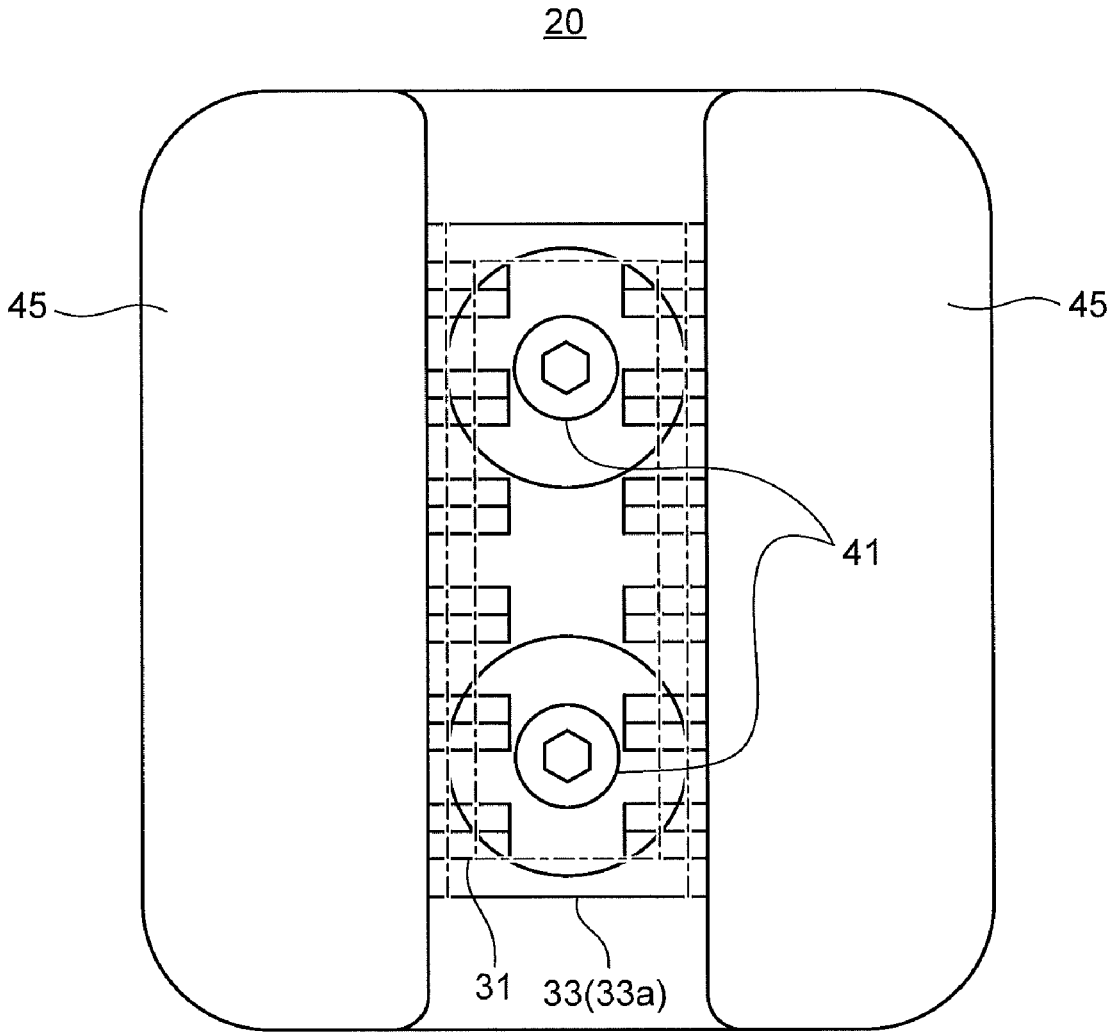
FIG. 5 is a top view of the fixed contact shown in FIG. 3.
Figure 6:
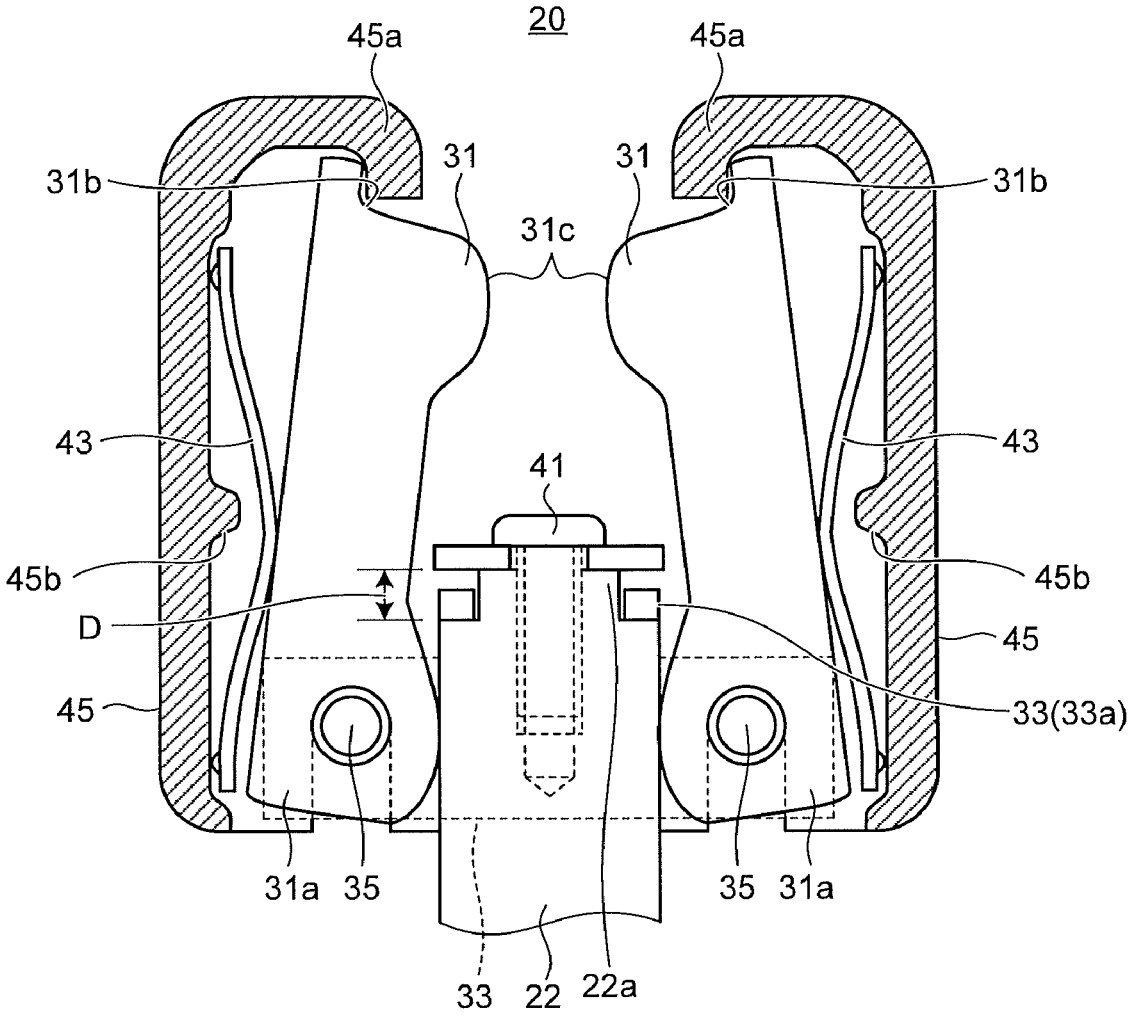
FIG. 6 is a sectional view taken along a line A-A in FIG. 3, depicting a fixed contact at the time of an open circuit.
Figure 7:
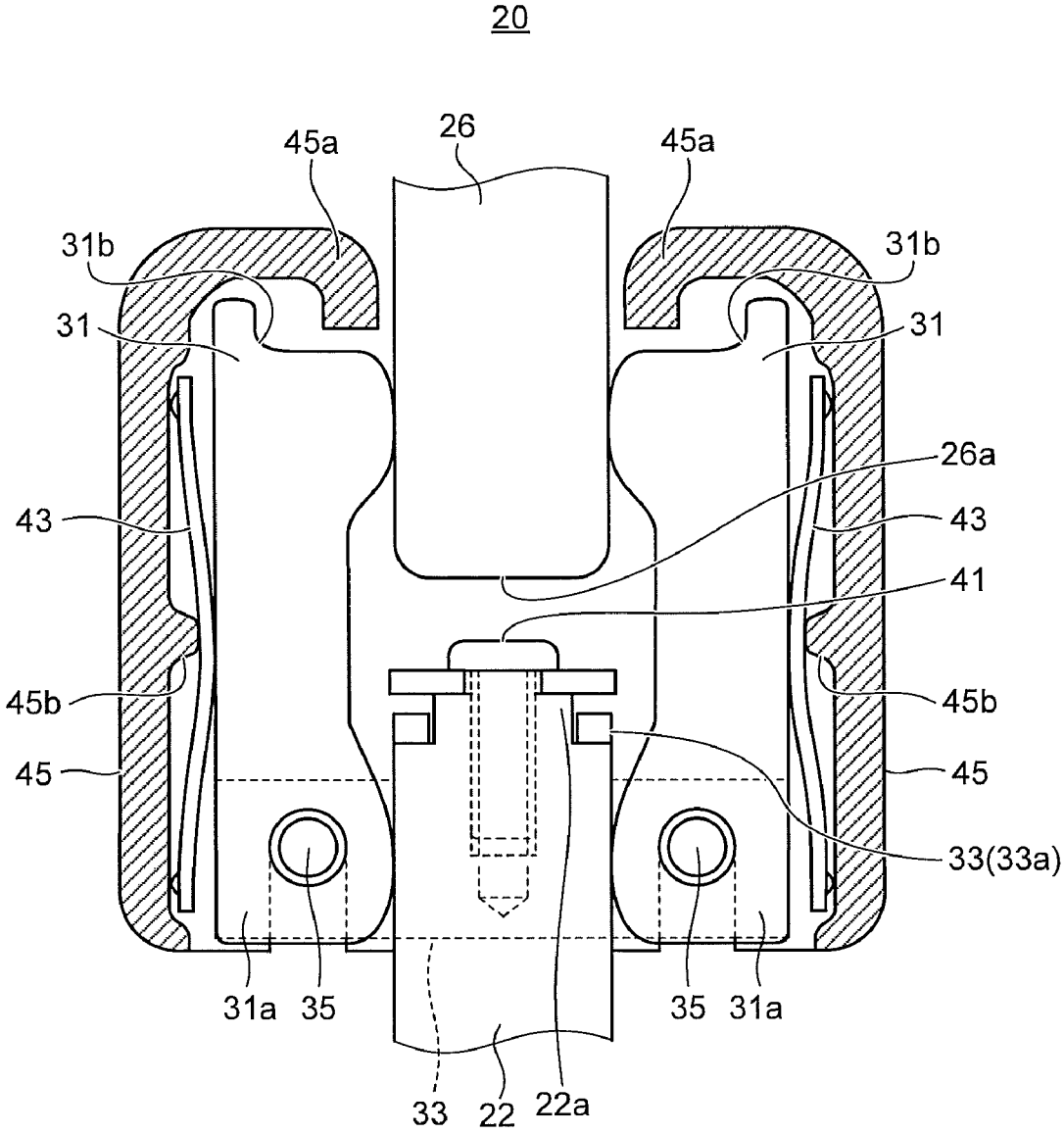
FIG. 7 is a sectional view taken along the line A-A in FIG. 3, depicting portions of a fixed contact and a moving contact at the time of a fully closed circuit.

FIG. 3 is a sectional view of the fixed contact on a plane including a rotation locus of the free end of the moving contact. FIG. 4 is a side view of the fixed contact shown in FIG. 3. FIG. 5 is a top view of the fixed contact shown in FIG. 3. FIG. 6 is a sectional view taken along a line A-A in FIG. 3, depicting the fixed contact at the time of an open circuit. FIG. 7 is a sectional view taken along the line A-A in FIG. 3, depicting portions of the fixed contact and the moving contact at the time of a fully closed circuit.

As shown in FIG. 3, the free end 26*a* of the moving contact 26 extends along the rotation locus L of the moving contact 26. By employing such a shape, an electric field of the free end 26*a* at the time of rotating it with a voltage applied can be relaxed without increasing the rotation range. A rectangular free end 26*a* is not preferable because an electric field concentrates on corner portions thereof.

The fixed contact 20 includes six pairs of conduction members 31, which are arranged opposedly and in parallel to each other. Tip ends of the conduction members 31 are oriented toward the opening 20*a*. The fixed contact 20 also includes a support frame (pedestal member) 33 that tiltably supports bases 31*a* of the conduction members 31, a leaf spring (pressurizing member) 43 that biases the conduction members 31 in a direction in which tip ends of the conduction members 31 approach each other, and an outer frame (shielding member) 45 that covers peripheries of the conduction member 31, the support frame 33 and the leaf spring 43 and shields them from an outside electric field.

Each of the conduction members 31 has a sponge-gourd flat plate-shaped contour and is provided at its side with a curved portion 31*c* (FIG. 6). The six pairs of conduction members 31 are arranged such that the curved portions 31*c* of each pair of conduction members 31 are adjacent to each other. The pair of conduction members 31 is arranged in a shape of an inverted V, and the six pairs of the conduction members 31 each arranged in the shape of an inverted V are spaced from one another at a predetermined distance in a direction of the rotation locus L of the moving contact 26. That is, twelve conduction members 31 are arranged in two rows six each such that their main surfaces are extending in parallel to each other. Each set of the six conduction members 31 forming each row is collectively supported by a support rod 35 inserted through a through hole formed in bases 31*a* thereof. The support rod 35 is loosely fitted in the through holes of the conduction members 31. With this configuration, the conduction members 31 are tiltably supported, and a width of a separating distance (opening width) between the tip ends of the conduction members 31 is variable.

Figure 8:
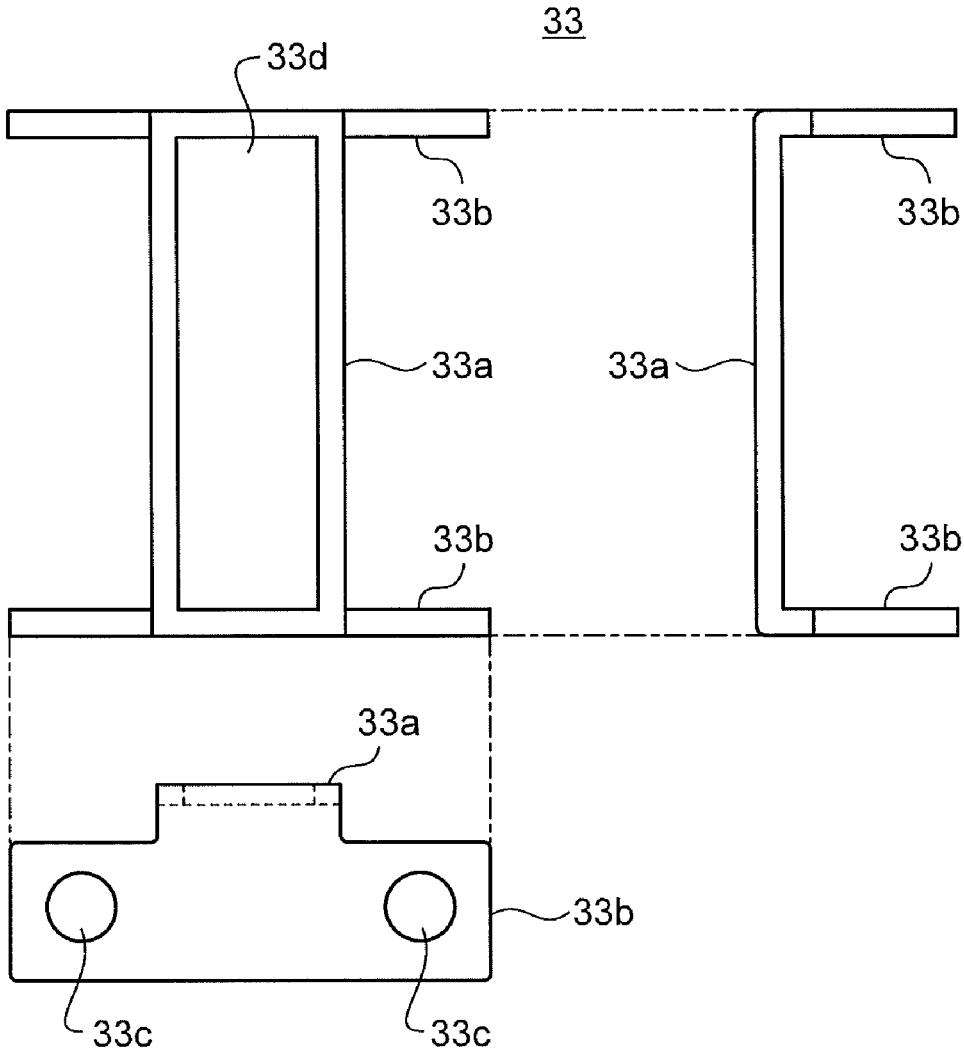
FIG. 8 depicts a state of a support frame (pedestal member) as viewed from front, a state thereof as viewed from a side, and a state thereof as viewed from bottom in association with each other.

FIG. 8 depicts the support frame (pedestal member) 33 as viewed from front, as viewed from side, and as viewed from bottom in association with each other. The support frame 33 includes a rectangular-frame-like frame portion 33*a*, and plate portions 33*b* that bend at two short sides of the frame portion 33*a* at right angles and extend in a longitudinal direction of the short side. Through holes 33*c* are formed in each of the plate portions 33*b*. The support rod 35 penetrates the through hole 33*c* to fix the support rod 35 and the outer frame 45. The support frame 33 forms a pedestal of the fixed contact 20. Each member of the fixed contact 20 is supported by the support frame 33. The support rod 35 is fastened to the outer frame 45 by a fastening member 37 (FIG. 3 and FIG. 4).

Figure 9:
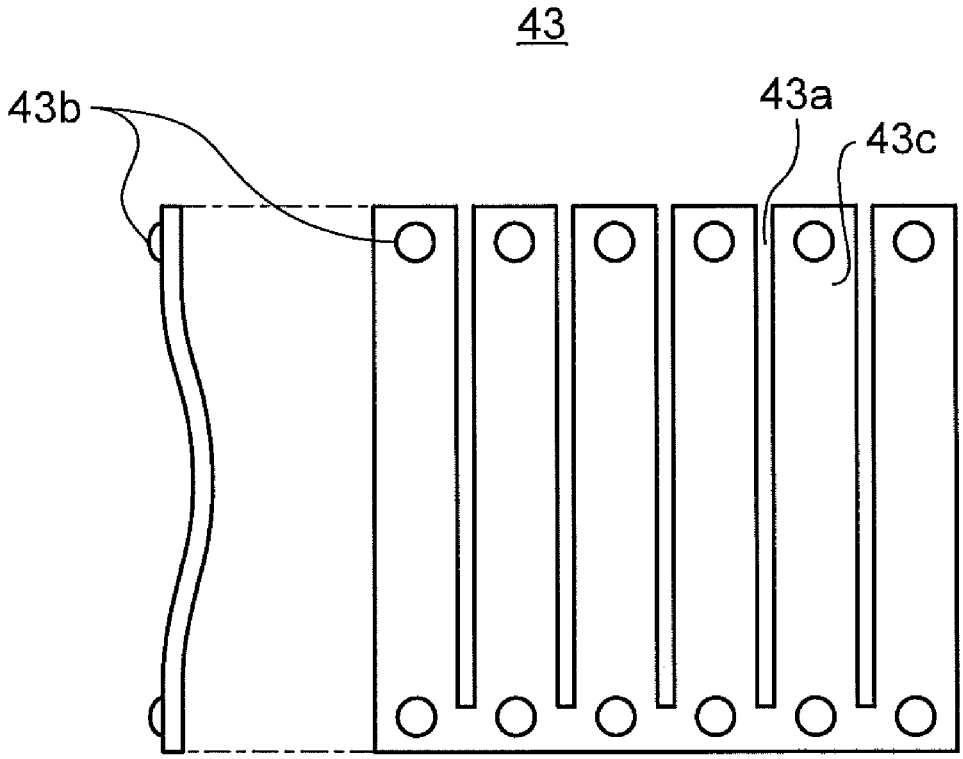
FIG. 9 depicts a state of a leaf spring (pressurizing member) as viewed from front and a state thereof as viewed from a side in association with each other.

The leaf spring (pressurizing member) 43 is a thin leaf spring having a dogleg-shape in cross section. The leaf spring 43 is arranged on an outer side of the opposed conduction members 31 (between the conduction member 31 and the outer frame 45) (FIG. 6 and FIG. 7). FIG. 9 depicts the leaf spring 43 as viewed from front and as viewed from a side in association with each other. Slits 43*a* are formed in the leaf spring 43 at the same pitch as that of the conduction members 31. The leaf spring 43 has a shape of teeth of a comb corresponding to gaps between the conduction members 31. A width of a tooth portion 43*c* divided by the slits 43*a* is made slightly greater than a thickness of the conduction member 31 so that even if the conduction member 31 comes into contact with the moving contact 26 and inclines, the conduction member 31 does not deviate from the tooth portion 43*c*. Embossed patterns 43*b* are formed on both ends (tip end and base end) of each tooth portion 43*c* so that abutting areas are reduced and contact motion is stabilized. The leaf spring 43 has a doglegged top, the top pushes a central portion of the conduction member 31 and the conduction member 31 is biased in a direction in which tip ends thereof approach each other. The pressurizing member is a thin leaf spring, and the pressurizing member is arranged on an outer side of the conduction members 31. With this configuration, the fixed contact is downsized, the structure thereof is simplified, and accordingly the entire switch is downsized. By pushing the central portion of the conduction member 31, a contact pressure of each contact is equalized. It is preferable that material of the leaf spring 43 has excellent spring characteristics, and for example, spring steel (such as SK and SUP) and spring stainless steel are preferable.

The outer frame 45 in the recessed-side of the dogleg-shape in cross section is provided with a projection 45*b* that regulate a warp of the leaf spring 43 to a predetermined amount. By providing the projection 45*b*, a warp of the leaf spring 43 when the moving contact 26 becomes eccentric and comes into contact is regulated to a predetermined value, and it is possible to prevent an excessive stress from being applied to the leaf spring 43. A position where the projection 45*b* is provided is in the recessed-side of the L-shape of the leaf spring 43. The projection 45*b* may be provided on the outer frame 45 or on a back surface of the leaf spring 43.

The slits 43*a* may be formed only in intermediate portions excluding both ends or may be formed over the entire length such that the tooth portions 43*c* are individually divided. It is preferable to arrange the leaf spring 43 such that the doglegged top is located on the side of the conduction member 31 as described above. However, even if the direction is reversed due to interference with another member or the like, substantially the same effect can be achieved.

The outer frame (shielding member) 45 is formed using casting that has high flexibility in terms of shape and that is effective for shielding the electric field. The outer frame 45 forms a shell of the fixed contact 20. The outer frame 45 is formed into a substantially box-like shape covering peripheries of the pair of conduction members 31 opposed substantially in parallel to each other, the support frame 33, and the leaf springs 43. The opening 20*a* through which the blade-type moving contact 26 enters is formed at a location corresponding to a gap between the tip ends of the conduction members 31. A portion of the outer frame 45 on the side of the connecting conductor 22 is opened for inserting an internal part and fixing it to the connecting conductor 22. Opposed edges of the tip end facing the opening 20*a* are bent inward so that a cross section thereof has a substantially L-shape. The outer frame 45 overcomes a biasing force of the leaf spring 43 by engaging the tip end that is formed as an engaging portion and that is bent so that a cross section thereof has substantially an L-shape, with a notch 31*b* formed at a tip end of the conduction member 31 as a to-be-engaged portion. Thus, the outer frame 45 maintains the opening width between the tip ends of the conduction members 31 at a predetermined width. The outer frame 45 is provided at its end on the side of the connecting conductor 22 with a U-shaped fastening notch. The support rod 35 is inserted into the fastening notch, and is fastened to the support frame 33 together with the support rod 35 by the fastening member 37 that is threadedly engaged with the support rod 35 (FIG. 3 and FIG. 4). In the present embodiment, the tip end of the outer frame 45 that is formed as the engaging portion and that is bent so that a cross section thereof has substantially an L-shape is engaged with the notch 31*b* formed at the tip end of the conduction member 31 that is the to-be-engaged portion. With this configuration, the opening width between the tip ends of the conduction members 31 is maintained at the predetermined width, a predetermined regulating member in the conventional technique is eliminated, and the structure of the switch is simplified. Further, the conduction member 31 that tilts in shape of an inverted V is regulated by the tip end. With this configuration, as compared with a case that the conduction member 31 is regulated at substantially the central portion thereof, a variation in the opening width is reduced even if a part size is varied by the same degree, and a variation in load when the moving contact 26 comes into contact and separates is regulated. In the present embodiment, the tip end of the conduction member 31 is provided with the notch 31*b* and the notch 31*b* is engaged with the substantially L-shape in cross section of the outer frame 45. In place of such notch 31*b*, a small protrusion protruding outward from substantially an arc contour may be provided on a tip end of a rounded conduction member so as to engage the protrusion with the substantially L-shape in cross section.

The connecting conductor 22 supports the entire fixed contact 20 by supporting the support frame 33. The connecting conductor 22 is provided at its tip end with a protrusion 22*a* having a height D greater than a plate thickness of the frame portion 33*a* (FIG. 6). The protrusion 22*a* penetrates and is fitted in a central rectangular hole 33*d* formed in the frame portion 33*a*. A retaining member 41 that has a screw and a washer is fastened to a tip end of the protrusion 22*a*, thereby preventing the support frame 33 from falling off. With this configuration, a play (backlash) is formed by a difference between the plate thickness of the frame portion 33*a* and the height of the protrusion 22*a*. The fixed contact 20 is movable due to this structure. The fixed contact 20 has such a structure that when the moving contact 26 enters the fixed contact 20 eccentrically, the fixed contact 20 slightly moves to follow toward the eccentric side, and the moving contact 26 smoothly comes into contact with the conduction members 31 of the fixed contact 20. In the present embodiment, the connecting conductor 22 is provided at its tip end with the protrusion 22*a* having the height greater than the plate thickness of the frame portion 33*a* of the support frame 33, and the protrusion 22*a* penetrates the frame portion 33*a* of the support frame 33, thereby forming the predetermined play (backlash). In place of the protrusion 22*a*, the predetermined play (backlash) may be formed by sandwiching a spacer, for example.

The two retaining members 41 each having the screw and the washer are inserted from the opening 20*a* of the outer frames 45 and are fastened to the protrusion 22*a* of the connecting conductor 22 (FIG. 3 and FIG. 5). Each of the retaining members 41 is provided at a location where it is separated away from the free end 26*a* of the moving contact 26 by a predetermined distance even when the moving contact 26 most closely approaches, so that the retaining member 41 does not come into contact with the moving contact 26. The retaining member 41 can be fastened from the side of the opening 20*a*. When an assembly that has the support frame 33, in which the conduction members 31, the support rods 35, the leaf springs 43, and the outer frame 45 are assembled, is to be fixed to the connecting conductor 22, the assembly is mounted on the protrusion 22*a*, and then the retaining members 41 are fastened by inserting a tool such as a torque wrench through the opening 20*a*. Thus, the assembling operation is facilitated. With this structure, an assembling space that is described in Patent Document 2 and required in the conventional technique can be eliminated.

In the switch having such a structure, the leaf springs (pressurizing member) 43 are arranged on outer sides of the opposed conduction members 31. Therefore, the space between the pair of conduction members 31 that are opposed to and in parallel to each other can be effectively utilized, and the height size of the fixed contact 20 can be reduced. By using the leaf springs 43 having the small thickness as the pressurizing member, the width size of the fixed contact 20 can be reduced and thus the entire switch can be downsized. The number of parts can be reduced as compared with a pressurizing structure of a conventional power-actuated type (a type in which conduction member is pressurized by another pressurizing member), and the size can be largely reduced as compared with a pressurizing structure of a conventional own-power type (a type in which conduction member is pressurized by bending of the conduction member itself).

The tip end of the outer frame 45 is engaged with the notch 31*b* formed at the tip end of the conduction member 31. With this configuration, the opening width between the tip ends of the conduction members 31 is maintained precisely. Therefore, a variation in load when the moving contact 26 comes into contact and separates can be regulated and the motion can be stabilized. The tip end of the outer frame 45 is utilized as a regulating structure. With this configuration, the number of parts is not increased and the regulating structure can be realized without increasing the entire size of the switch.

Furthermore, in the switch according to the present embodiment, the support frame (pedestal member) is supported by the connecting conductor (support conductor) 22 with a predetermined play. Therefore, the fixed contact 20 is movable with respect to the moving contact 26 with the simple structure and with the easy assembling method. When the moving contact 26 enters in the fixed contact 20, the motion becomes smooth and the reliability is enhanced.

Furthermore, in the switch according to the present embodiment, the plurality of conduction members 31 are provided at predetermined distances from one another in the direction of the rotation locus of the moving contact 26. The leaf spring (pressurizing member) 43 has the same number of the tooth portions 43*c* as that of the conduction members 31 as a partial slit structure. Therefore, a contact pressure can be applied to the plurality of conduction members 31 individually, and when the moving contact 26 enters, the conduction members 31 can be independently operated. Thus, it is possible to prevent the inserting force from increasing. Because the leaf spring 43 is formed to have an integrated structure with partial slits, the handling thereof is facilitated.

INDUSTRIAL APPLICABILITY

The switch according to the present invention is useful when it is applied to a switch that has a blade-type moving contact, which is rotatably and pivotally supported and reciprocates such that its free end draws a rotation locus, and a fixed contact that has a conduction member with which the moving contact comes into contact.

The invention claimed is:

1. A switch comprising a blade-type moving contact, which is rotatably and pivotally supported and reciprocates such that a free end of the blade-type moving contact draws a rotation locus, and a fixed contact that has conduction members with which the moving contact comes into contact, wherein the fixed contact comprises a pair of the conduction members that are arranged opposedly and substantially in parallel to each other such that tip ends of the conduction members are oriented toward an opening, a pedestal member that tiltably supports bases of the conduction members, a pressurizing member that biases the conduction members in a direction in which the tip ends of the conduction members approach each other, and a shielding member that covers peripheries of at least the conduction members and the pressurizing member and shields them from an outside electric field, the pressurizing member is arranged on an outer side of the opposed conduction members, and the shielding member engages with the tip ends of the conduction members, overcomes a biasing force of the pressurizing member, and maintains an opening width between the tip ends of the conduction members at a predetermined width.

2. The switch according to claim 1, wherein a tip end of the shielding member is engaged with a notch formed at the tip end of the conduction member, thereby maintaining the opening width between the tip ends of the conduction members at a predetermined width.

3. A switch comprising a blade-type moving contact, which is rotatably and pivotally supported and reciprocates such that a free end of the blade-type moving contact draws a rotation locus, and a fixed contact that has conduction members with which the moving contact comes into contact, wherein the fixed contact comprises a pair of the conduction members that are arranged opposedly and substantially in parallel to each other such that tip ends of the conduction members are oriented toward an opening, a pedestal member that tiltably supports bases of the conduction members, a pressurizing member that biases the conduction members in a direction in which the tip ends of the conduction members approach each other, and a shielding member that covers peripheries of at least the conduction members and shields them from an outside electric field, and the pedestal member is supported by a support conductor with a predetermined play so that the pedestal member is movable in a direction perpendicular to a plane including the rotation locus of the moving contact.

4. The switch according to claim 3, wherein the support conductor includes at its tip end a protrusion that protrudes in a direction from the bases toward the tip ends of the conduction members, the protrusion is fitted in a hole formed in the pedestal member, and a retaining member is fixed to a tip end of the protrusion, thereby movably supporting the pedestal member with a predetermined play.

5. The switch according to claim 4, wherein the retaining member is separated at a predetermined distance from the free end of the moving contact that is at a location where the moving contact most closely approaches.

6. The switch according to claim 1, wherein a plurality of the conduction members are arranged along a direction of the rotation locus of the moving contact, and the pressurizing member has a comb-like shape having tooth portions the number of which corresponds to the number of the conduction members.

7. The switch according to claim 1, wherein the pressurizing member is of a thin leaf spring shape having a dogleg-shape in cross section, and a central portion of the conduction member is pressed by a top of the dogleg-shape.

8. The switch according to claim 7, wherein a projection that regulates a warp amount of the pressurizing member to a predetermined value is provided in a recessed side of the dogleg-shape in cross section of the pressurizing member.

9. The switch according to claim 7, wherein the pressurizing member is of a thin leaf spring whose midsection curves convexly toward the conduction member.

10. A switch comprising a blade-type moving contact, which is rotatably and pivotally supported and reciprocates such that a free end of the blade-type moving contact draws a rotation locus, and a fixed contact that has conduction members with which the moving contact comes into contact, wherein the fixed contact comprises a pair of the conduction members that are arranged opposedly and substantially in parallel to each other such that tip ends of the conduction members are oriented toward an opening, a pressurizing member that biases the conduction members in a direction in which the tip ends of the conduction members approach each other, and an outer frame that covers peripheries of at least the conduction members and the pressurizing member, the pressurizing member is arranged on an outer side of the opposed conduction members, the pressurizing member is of a thin leaf spring shape having a dogleg-shape in cross section, and a central portion of the conduction member is pressed by a top of the dogleg-shape, and a projection that regulates a warp amount of the pressurizing member to a predetermined value is provided in a recessed side of the dogleg-shape in cross section of the pressurizing member.

11. The switch according to claim 10, further comprising a pedestal member that tiltably supports bases of the conduction members.

12. The switch according to claim 10, wherein the outer frame engages with the tip ends of the conduction members, overcomes a biasing force of the pressurizing member, and maintains an opening width between the tip ends of the conduction members at a predetermined width.

13. The switch according to claim 12, wherein a tip end of the outer frame is engaged with a notch formed at the tip end of the conduction member, thereby maintaining the opening width between the tip ends of the conduction members at a predetermined width.

14. The switch according to claim 10, wherein a plurality of the conduction members are arranged along a direction of the rotation locus of the moving contact, and the pressurizing member has a comb-like shape having tooth portions the number of which corresponds to the number of the conduction members.

15. The switch according to claim 11, wherein the pedestal member is supported by a support conductor with a predetermined play so that the pedestal member is movable in a direction perpendicular to a plane including the rotation locus of the moving contact.

16. The switch according to claim 15, wherein the support conductor includes a protrusion that protrudes from the pedestal member in a direction from the bases toward the tip ends of the conduction members, the protrusion is fitted in a hole formed in the pedestal member, a retaining member is fixed to a tip end of the protrusion, and the pedestal member is movably supported via the protrusion and the hole with a predetermined play.

17. The switch according to claim 16, wherein the retaining member is separated at a predetermined distance from the free end of the moving contact that is at a location where the moving contact most closely approaches.

* * * * *